US008138982B1

(12) United States Patent
West et al.

(10) Patent No.: US 8,138,982 B1
(45) Date of Patent: Mar. 20, 2012

(54) MUNITIONS/ARTILLERY SHELL GPS MULTI-EDGE SLOT ANTI-JAMMING ARRAY

(75) Inventors: James B. West, Cedar Rapids, IA (US); Lee M. Paulsen, Cedar Rapids, IA (US); Daniel N. Chen, Diamond Bar, CA (US); Kendra L. Kumley, Boulder, CO (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 1302 days.

(21) Appl. No.: 11/821,824

(22) Filed: Jun. 26, 2007

(51) Int. Cl.
*H01Q 1/28* (2006.01)
*F41G 7/00* (2006.01)
*F42B 10/00* (2006.01)

(52) U.S. Cl. ..... 343/705; 343/770; 102/384; 244/3.14; 244/3.19

(58) Field of Classification Search ..... 343/705, 343/708, 769, 770; 102/384; 244/3.14, 3.19, 244/3.24, 3.26
See application file for complete search history.

(56) References Cited

U.S. PATENT DOCUMENTS 6,020,854 A * 2/2000 Jagnow et al. ..... 343/705
6,098,547 A * 8/2000 West ..... 102/214
6,307,514 B1 * 10/2001 West ..... 343/705
6,473,041 B2 * 10/2002 Koch et al. ..... 343/700 MS

* cited by examiner

*Primary Examiner* — Tan Ho
(74) *Attorney, Agent, or Firm* — Donna P. Suchy; Daniel M. Barbieri

(57) ABSTRACT

The present invention is a multi-element anti-jamming (A/J) antenna array. The antenna array includes a first multi-band GPS edge-slot antenna and a second multi-band GPS edge-slot antenna. The first edge-slot antenna and the second edge-slot antenna are configured for implementation within at least one of an artillery shell and a munition. The first edge-slot antenna and the second edge-slot antenna are each further configured for supporting L-band frequencies.

18 Claims, 13 Drawing Sheets

MUNITIONS/ARTILLERY SHELL GPS MULTI-EDGE SLOT ANTI-JAMMING ARRAY

FIELD OF THE INVENTION

The present invention relates to the field of artillery shells and more particularly to a GPS Multi-Edge Slot Anti-Jamming (A/J) Array for implementation with an artillery shell.

BACKGROUND OF THE INVENTION

Artillery shells typically utilize a fuse installed at the leading end of the shell. The fuse may be a mechanical or electronic device designed to control the detonation of the explosive charge (ex—payload) of the shell. A number of currently available artillery shell fuses include electronics and telemetry systems for promoting improved accuracy and detonation control. Electronic circuits disposed in the fuse remain in radio-frequency contact with a ground station after launch of the shell for coordinating the trajectory of the shell and making course corrections as necessary. Further, the artillery fuse may operate in conjunction with a satellite-based positioning system, such as the NAVSTAR global positioning systems (GPS), maintained and operated by the United States government, for accurately determining the coordinates of the shell as it travels along its trajectory and reaches the point of impact, and for correcting the trajectories of subsequently fired munitions. GPS may also be used as a positional reference to deploy retractable airfoil flaps of an artillery shell, from a previous free fall state, to more accurately control the downward descent of the artillery shell towards the target.

An artillery shell fuse having telemetry and positioning system electronics requires an antenna suitable for the application and environment to which an artillery shell is subject. A number of currently available antennas have radiation patterns which are omni-directional in orthogonal directions about the shell trajectory and thus, may be capable of being jammed from terrestrial positions. Other currently available antennas may be subject to performance degradation effects including carrier-phase roll up, phase carrier wrap, and roll-ripple due to antenna asymmetry.

Thus, it would be desirable to have an antenna system for artillery shells which addresses the problems associated with current solutions.

SUMMARY OF THE INVENTION

Accordingly an embodiment of the present invention is directed to an artillery shell, including: a payload; a guidance system including a radio receiver; and a multi-element antenna array communicatively coupled to the radio receiver, the antenna array including a first antenna and a second antenna, wherein the first antenna and the second antenna are edge-slot antennas.

A further embodiment of the present invention is directed to a multi-element anti-jamming (A/J) antenna array, including: a first edge-slot antenna; and a second edge-slot antenna, wherein the first edge-slot antenna and the second edge-slot antenna are configured for implementation within at least one of an artillery shell and a munition.

An additional embodiment of the present invention is directed to a multi-element anti-jamming (A/J) antenna array, including: a first multi-band GPS edge-slot antenna; and a second multi-band GPS edge-slot antenna, wherein the first edge-slot antenna and the second edge-slot antenna are configured for implementation within at least one of an artillery shell and a munition, the first edge-slot antenna and the second edge-slot antenna each being further configured for supporting L-band frequencies.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

An artillery shell fuse having telemetry and positioning system electronics requires an antenna suitable for the application and environment to which an artillery shell is subject. The antenna should be able to survive the extreme acceleration and high rotational velocities typical of gun-launched projectiles. Further, the radiation pattern of the antenna telemetry should exhibit relatively high gain in the aft direction (i.e., the direction opposite the direction of travel of the shell), while the radiation pattern for the GPS system should be minimal in the direction of travel of the shell to minimize or prevent jamming from the vicinity of the target area of the shell. Such an antenna should be of sufficiently reduced size so as not to occupy a large amount of space within the interior of the fuse, and is preferably designed for operation with L-band and S-band signals. ("L" being the letter designation for microwave signals in the frequency range from 1 to 2 GHz; "S" being the letter designation for microwave signals in the frequency range from 2 to 4 GHz).

Figure 1:
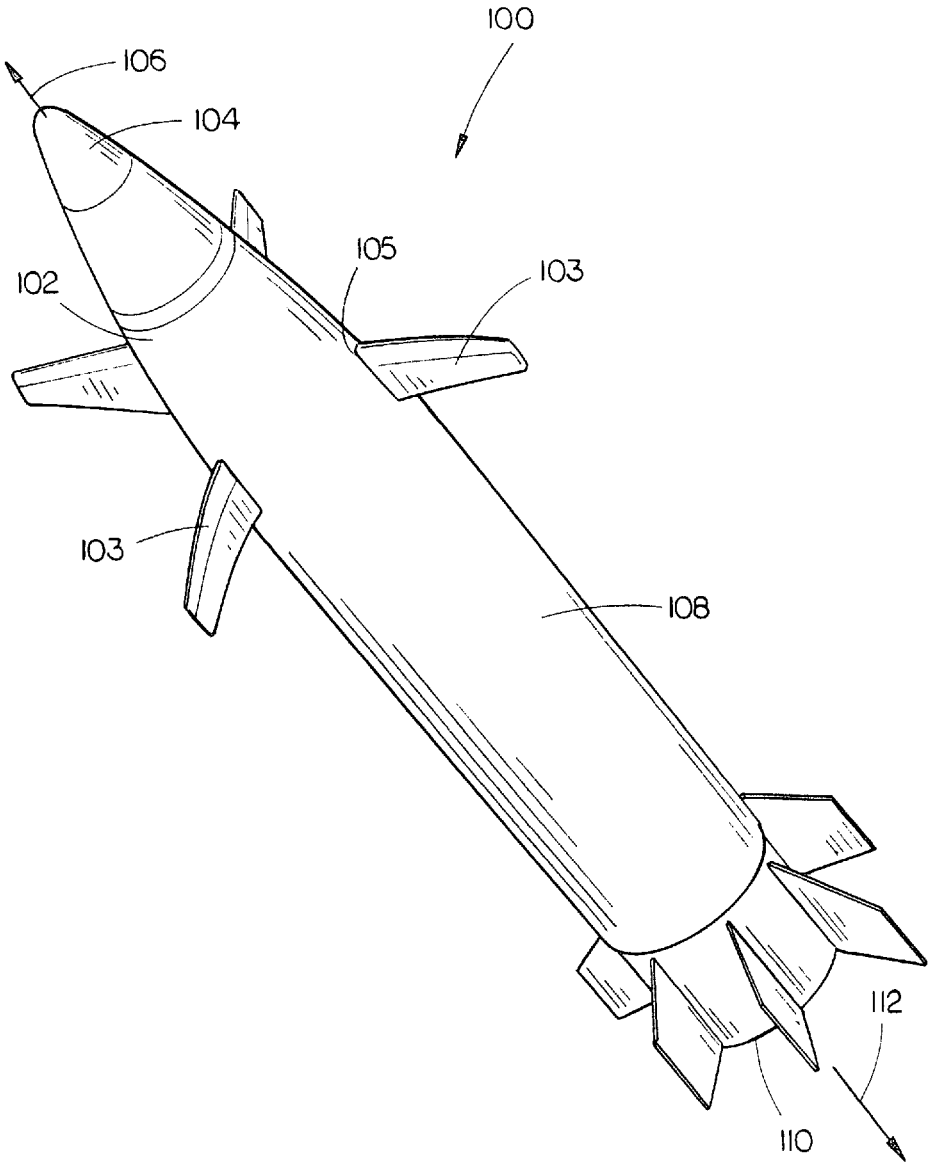
FIG. 1 is an illustration of an artillery shell in accordance with an exemplary embodiment of the present invention.
Figure 2A:
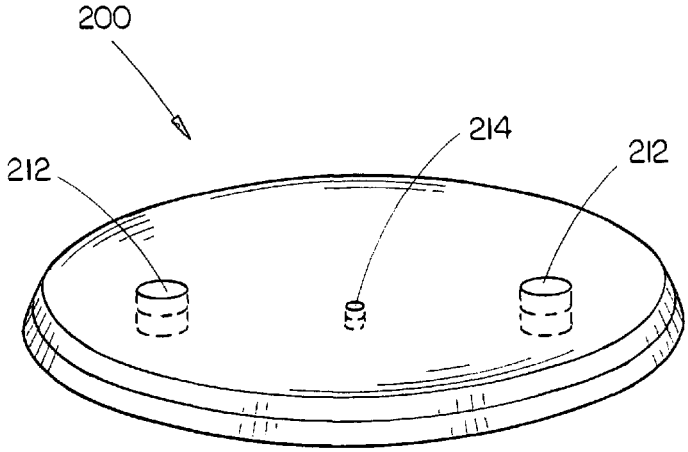
FIGS. 2A and 2B are perspective views of a dual band edge-slot antenna in accordance with an exemplary embodiment of the present invention.
Figure 2B:
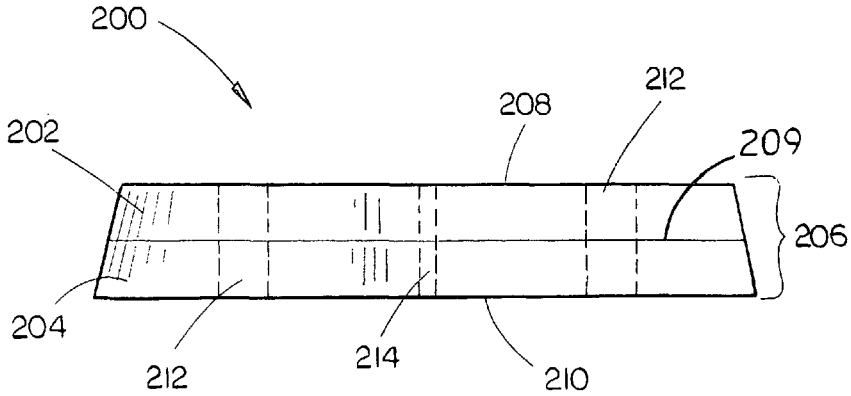

Referring now to FIG. 1, an artillery shell in accordance with the present invention is shown. The artillery shell 100 or similar munition is typically launched or fired from a cannon, mortar, or similar type of gun (not shown). A fuse 104 is disposed at the nose 102 of the artillery shell 100 and is typically physically contiguous with the body 108 of the shell. The fuse 104 may be a mechanical or electronic device utilized for detonating an explosive charge, such as the charge or payload of the artillery shell 100 or similar munition. The artillery shell 100, when launched or otherwise projected, generally travels in a forward direction 106 toward the vicinity of a target. During flight, the rear 110 of the artillery shell 100 generally points in the aft direction 112 toward the vicinity of origin of the shell (ex—toward the gun from which the shell was launched). In exemplary embodiments, during flight, retractable airfoil flaps 103 or any like selectively deployable airfoil mechanism may be deployed to change the trajectory of the shell 100. Retractable airfoil flaps 103 are shown as extending from slots 105.

Figure 11:
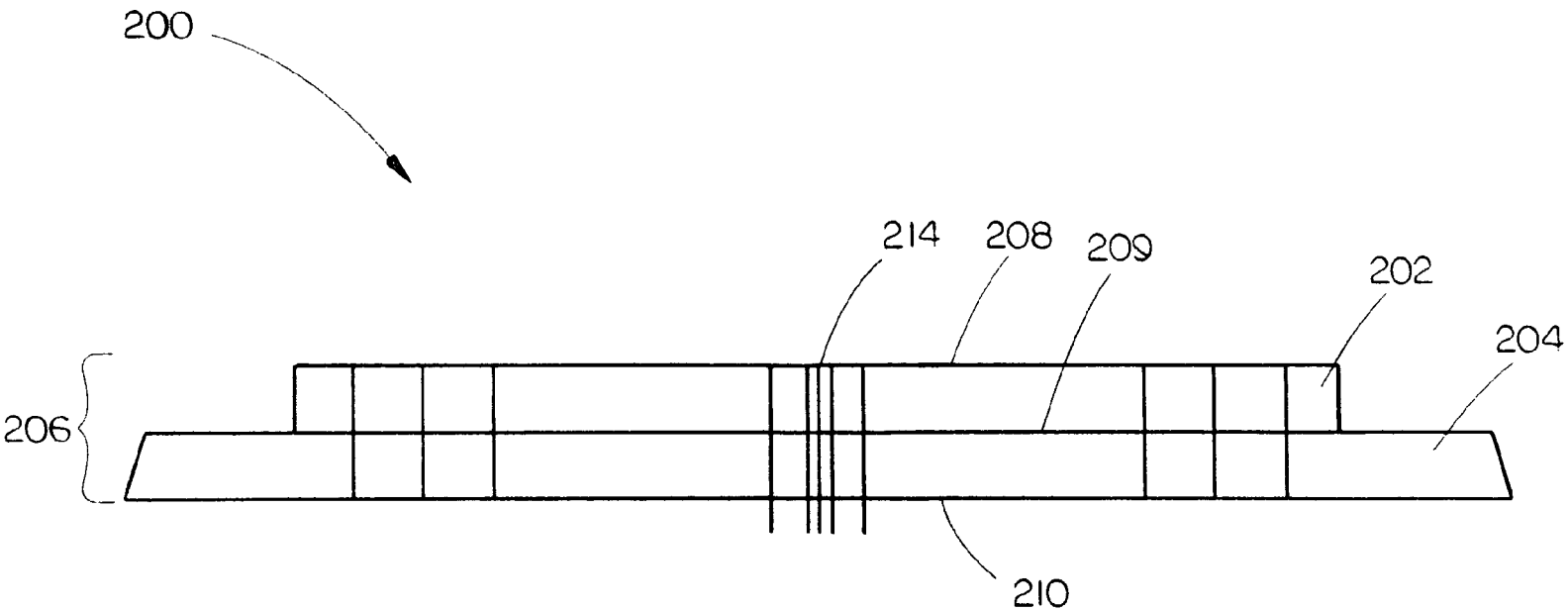
FIG. 11 is a perspective view of a dual band edge-slot antenna in accordance with an alternative exemplary embodiment of the present invention.

Referring generally to FIGS. 2A through 5B and FIG. 11, an antenna 200 in accordance with an exemplary embodiment of the present invention is shown. In a current embodiment of the present invention, the antenna 200 is an edge slot radiator/edge slot antenna/radial transmission line antenna. For example, the edge slot antenna 200 may be a multi-band edge slot antenna, such as a dual band edge slot antenna having an L1 band/substrate 202, which may support an L1 GPS frequency (ex—1.575 GHz) and an L2 band/substrate 204, which may support an L2 GPS frequency (ex—1.227 GHz). In additional embodiments, the multi-band edge slot antenna 200 may support other L-band frequencies, such as L3, L5 or the like. In further embodiments, the multi-band edge slot antenna 200 may support S-band frequencies (such as for telemetry and control) and C-band frequencies (such as for Height of Burst (HOB)-related direction finding). In exemplary embodiments, the L1 band 202 and the L2 band 204 may be slanted edge discs. In alternative embodiments, the L1 band 202 and the L2 band 204 may be recessed and have straight edges (as shown in FIG. 11). The edge slot antenna 200 substrates (202, 204) may be disk-shaped, dielectric substrates (202, 204), which may be formed of Teflon-fiber-glass or similar RF dielectric material.

In further embodiments, the substrates 202, 204, (collectively shown as a substrate assembly 206) may be metal-plated (ex—copper-plated), such as on an upper surface (ex—upper edge slot ground) 208 of the substrate assembly 206, a middle surface 209 of the substrate assembly 206, and a lower surface (ex—lower edge slot ground) 210 of the substrate assembly 206. Further, the first substrate 202 (ex—GPS L1) and the second substrate 204 (ex—GPS L2) are separated by the middle surface 209, said middle surface forming a boundary for individual radiating elements of the edge slot antenna 200. Additionally, the antenna 200 may be configured with one or more shunt inductive posts 212, such as fixed shunt L inductive tuning posts. The posts 212 may be tunable by means of embedded tuning varactor diodes, PIN diode switches, or the like. The posts 212 may allow for adjusting of roll pattern symmetry (see FIGS. 7A through 8B) and may further be utilized to facilitate input impedance match. In exemplary embodiments, the posts 212 may be hollow, metallic posts configured for routing bias and control signals through the antenna 200.

In additional embodiments, the substrate 206 may further have a centrally located aperture formed therethrough, for receiving an input pin/pin probe 214. For example, the pin probe 214 may be an extension of a center conductor of a L1/L2 coaxial feed for providing a common L1/L2 input. The antenna 200 may be fed via the input pin 214, such that each of the radiating elements of the antenna are simultaneously excited in-phase. Further, the input 214 of the antenna 200 may be impedance-matched to a characteristic impedance of an RF feed or an RF transceiver assembly via an additional layer of RF microstrip or stripline circuit board (ex—an RF match board), such as via numerous known techniques. For example, the RF match board may be integrated into the RF transceiver assembly.

Figure 3:
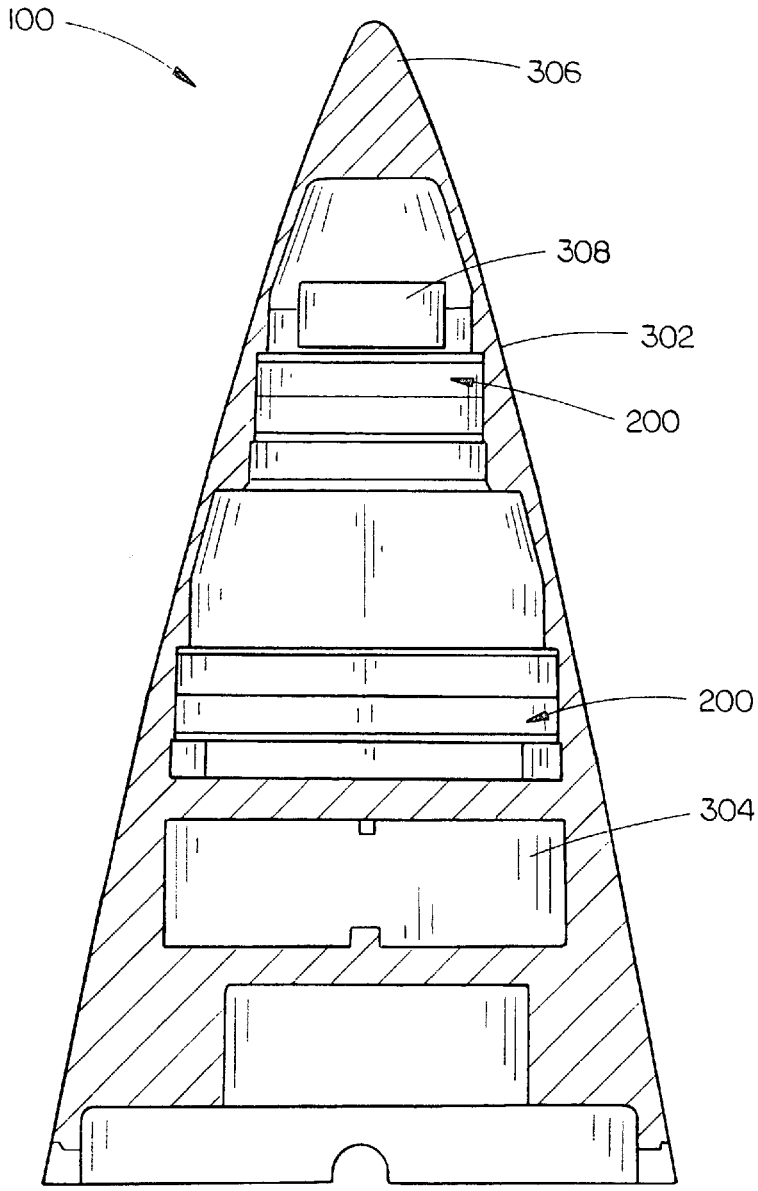
FIG. 3 is a cutaway view of an artillery shell implementing dual band edge-slot antennas in accordance with an exemplary embodiment of the present invention.

In exemplary embodiments, two or more antennas 200, each as described above, may be implemented in the present invention to form a multi-edge slot antenna array. For example, the antennas 200 may be conformal antennas (sized so as not to perturb general shape of the projectile) which may be implemented within an artillery shell 100 (such as being embedded in a radome 302 of the artillery shell 100 as shown in FIG. 3) and may be configured for receiving signals (such as GPS signals) via electronics 304 (ex—DIGNU/IGS 200 (Deeply Integrated Guidance Navigation Unit/Inertial Guidance System 200)) contained within the artillery shell 100 for promoting course or trajectory correction functionality for the artillery shell (as will be described further below). In embodiments implementing two antennas 200, each antenna 200 may implement multiple ground layers, such as three RF ground layers (208, 209 and 210) and may further implement multiple dielectric layers, such as two dielectric layers (202 and 204). Stacked, integrated multi-band antenna assemblies, such as dual band antenna assemblies 200 may be configured to share a common ground layer (ex—RF ground layer 209). Further, for multi-band antenna assemblies with more than two bands, a third dielectric layer may be included which shares a common ground layer with one of the first/second dielectric layers. Further, multiple frequencies may be supported by each antenna 200. For instance, each dual band antenna assembly 200 may support a first frequency (ex—L1) and a second frequency (ex—L2).

In current embodiments of the present invention, the antennas 200 may be fuse-mounted. In exemplary embodiments, multi-band antennas 200 of the present invention may be implementable alone or in Proxy Fuse (Proximity Fuse) munition/artillery shell systems for fuse-tip/metal nose tip 306 mount. For example, a GPS, multi-band antenna 200 of the present invention may be implemented in an artillery shell/munition 100 with a Prox/C-band Prox/Proxy Fuse/Proximity Fuse/Proximity Communication System/Height of Burst Sensor (HOB) antenna 308, such that the GPS antenna (s) and the Prox Antenna(s) can be independent of one another within the fuse tip. In additional embodiments, the antenna 200 may be frequency scaled for providing a simplified direction guidance system for guiding an emitter signal into a null of the antenna's radiation pattern for a power detection based steering system, which may promote neutralization of jammer signal emitters in some CONOPS (Concept of Operations) scenarios.

Further, the antennas 200 may be constructed of conventional microwave printed circuit materials which may allow said antennas to be sized/constructed so that they have fuse-compatible dimensions. In further embodiments, the antennas 200 may form an antenna array which is electrically small (ex—the largest dimension of an antenna in the array is no more than one-tenth of a wavelength).

Figure 4:
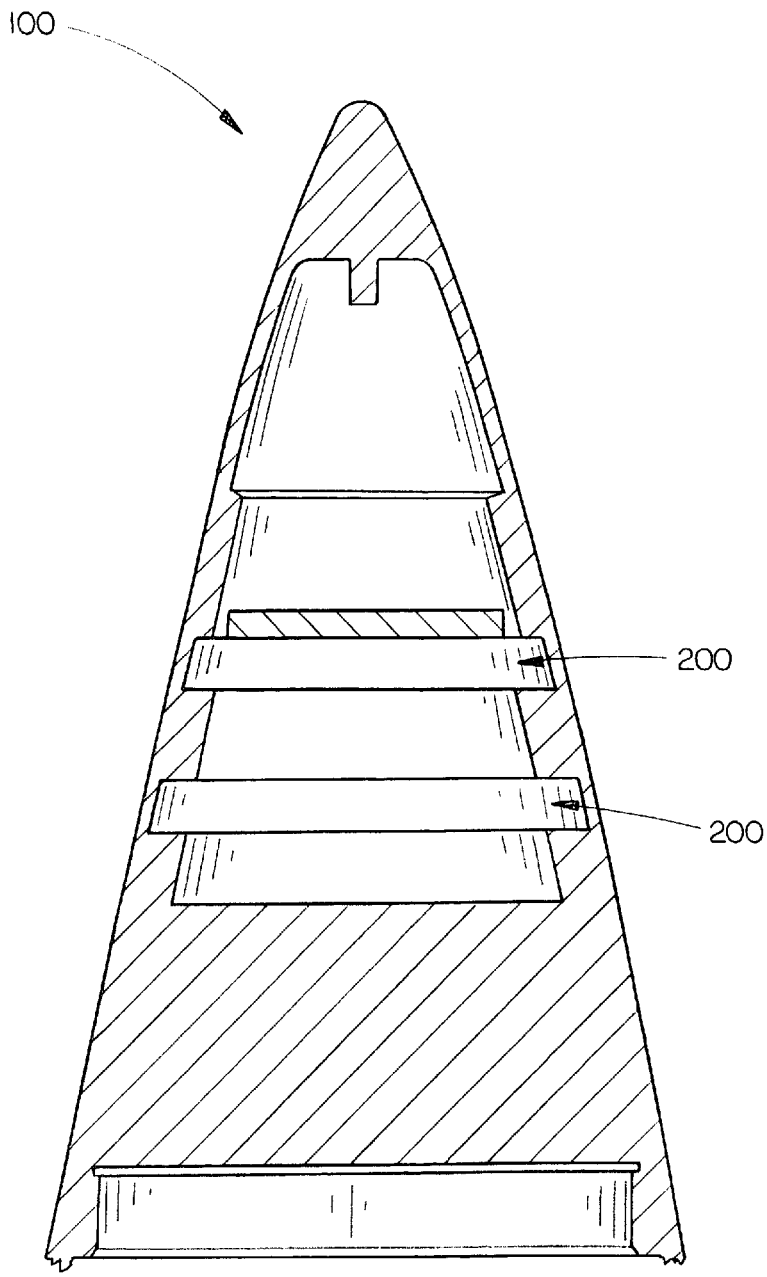
FIG. 4 is a cutaway view of an artillery shell implementing dual band edge-slot antennas in accordance with an exemplary embodiment of the present invention.

In current embodiments of the present invention, the antennas 200 provide simultaneous multi-band (ex—L1/L2) GPS functionality which may allow for exploitation of edge slot inherent linear polarization and axial phase center/axial phase symmetry for promoting GPS accuracy and minimization of phase carrier wrap/phase wrapping effect which is often a problem with spinning vehicles (ex—spinning artillery shells, munitions). Further, the antenna array may include two or more multi-element antennas 200 for promoting maximized anti-jamming (A/J) performance and for providing an anti-jamming array. For instance, such an array allows for exploitation of natural low inherent mutual coupling of edge slot antennas for collinear array applications, as shown in FIG. 4, in which two dual band antennas 200 are implemented. In exemplary embodiments, the number of A/J nulls may be proportional to the number of antenna elements. Further, the antenna array of the present invention may allow for exploitation of electrical small dimension of slot effective height to maximize intra-element array spacing to promote maximized anti-jamming performance. In additional embodiments, the antenna array has rotationally symmetric phase center properties for L1/L2 A/J and non-A/J GPS munitions and artillery shell applications (ex—for munitions and small diameter bomb (SDB) platforms.

Figures 6A, 6B:
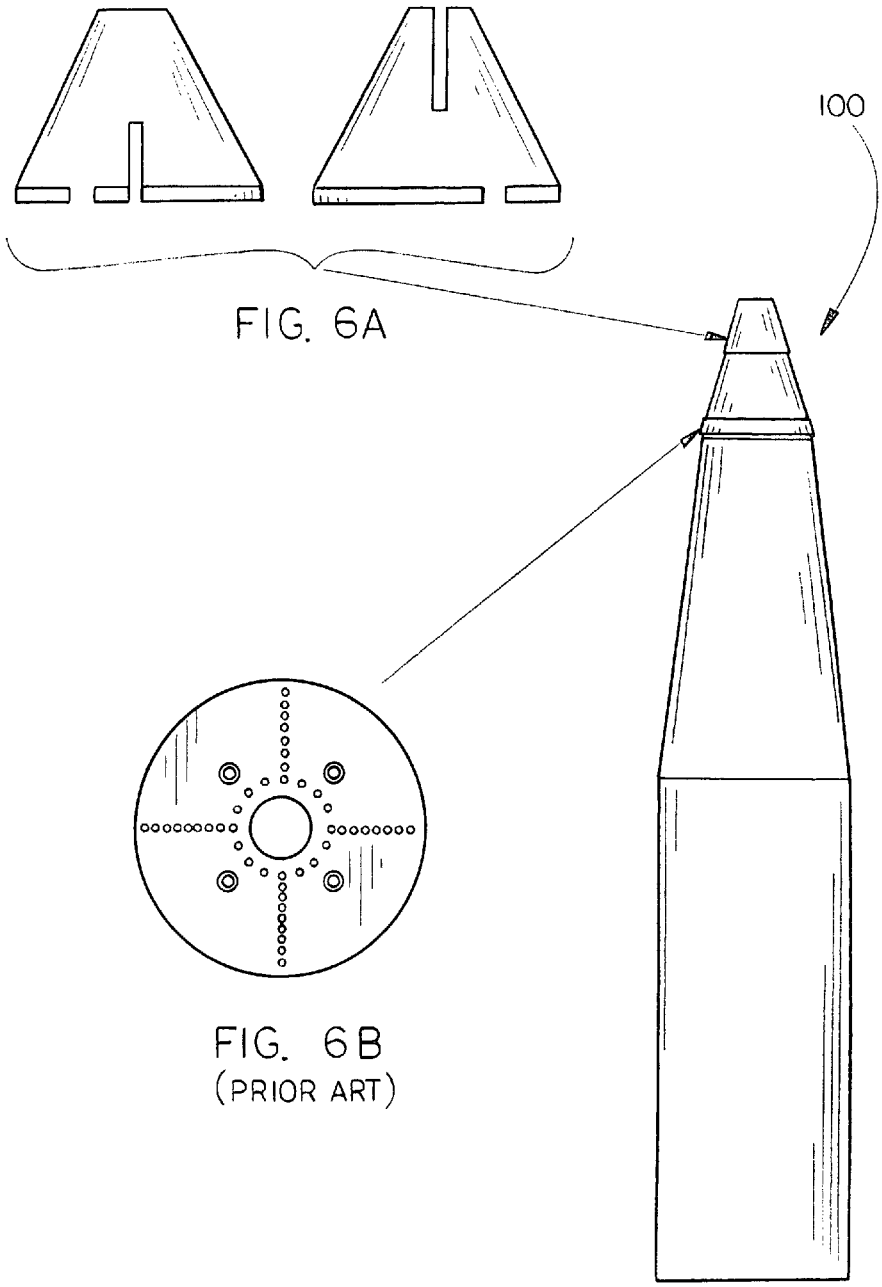
FIG. 6B (PRIOR ART)
FIG. 6A is a view of a folded/multi-band folded monopole (potted fuse tip assembly) antenna for use in conjunction with an edge-slot antenna in an artillery shell/munition in accordance with alternative exemplary embodiments of the present invention.
FIG. 6B is a view of a sectoral circular slot antenna array for use in conjunction with an edge-slot antenna in an artillery shell/munition in accordance with alternative exemplary embodiments of the present invention.
Figure 7A:
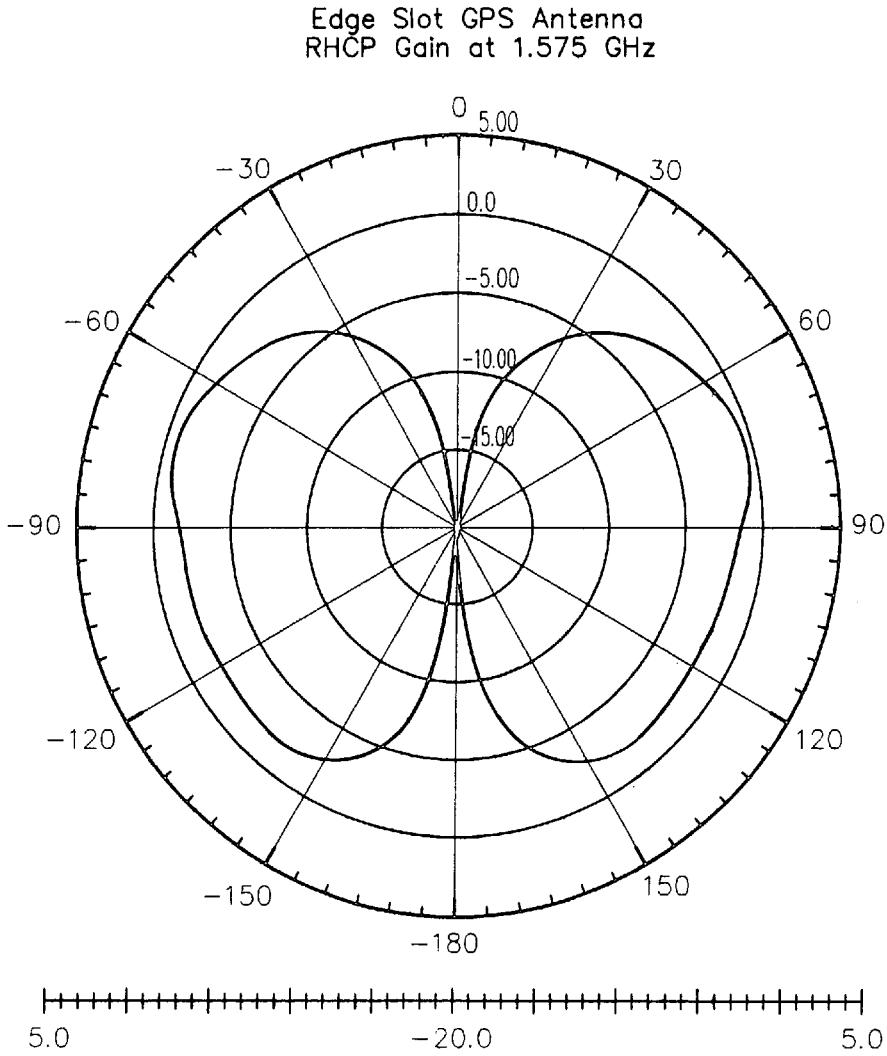
FIGS. 7A through 8B are illustrations of radiation patterns which may be produced by an edge-slot antenna array of the present invention.
Figure 7B:
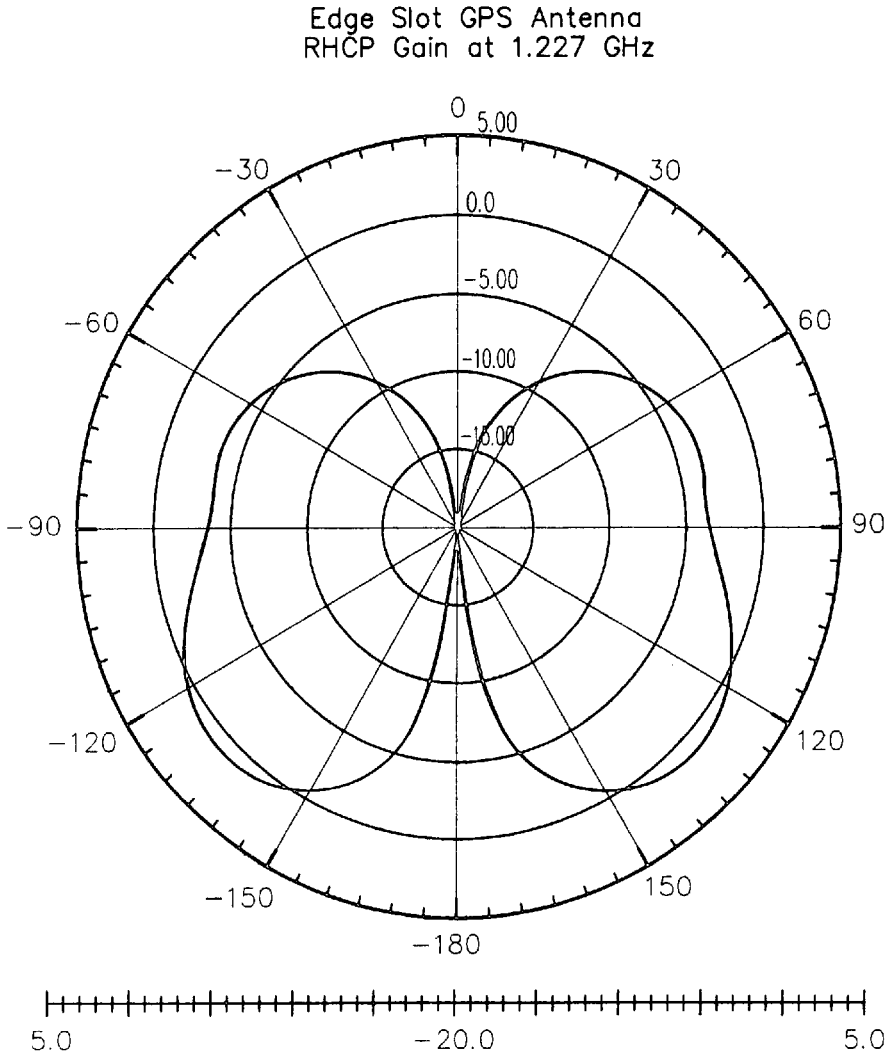
Figure 8A:
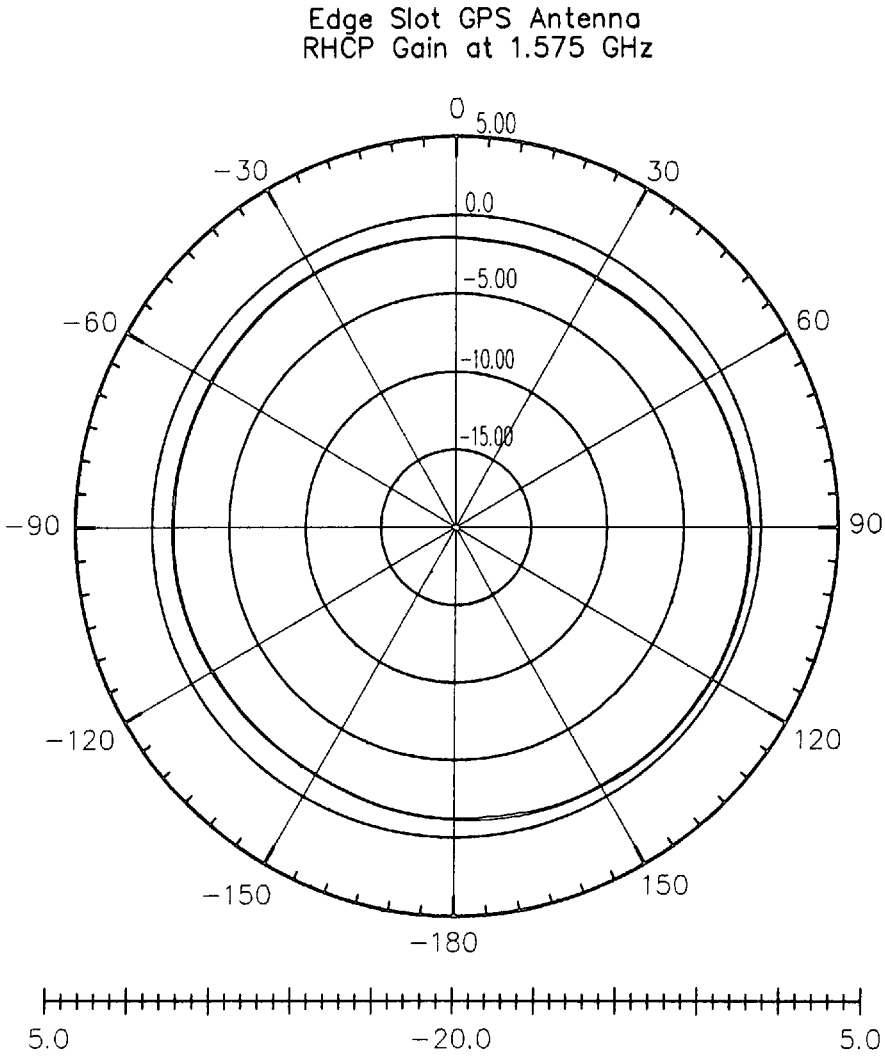
Figure 8B:
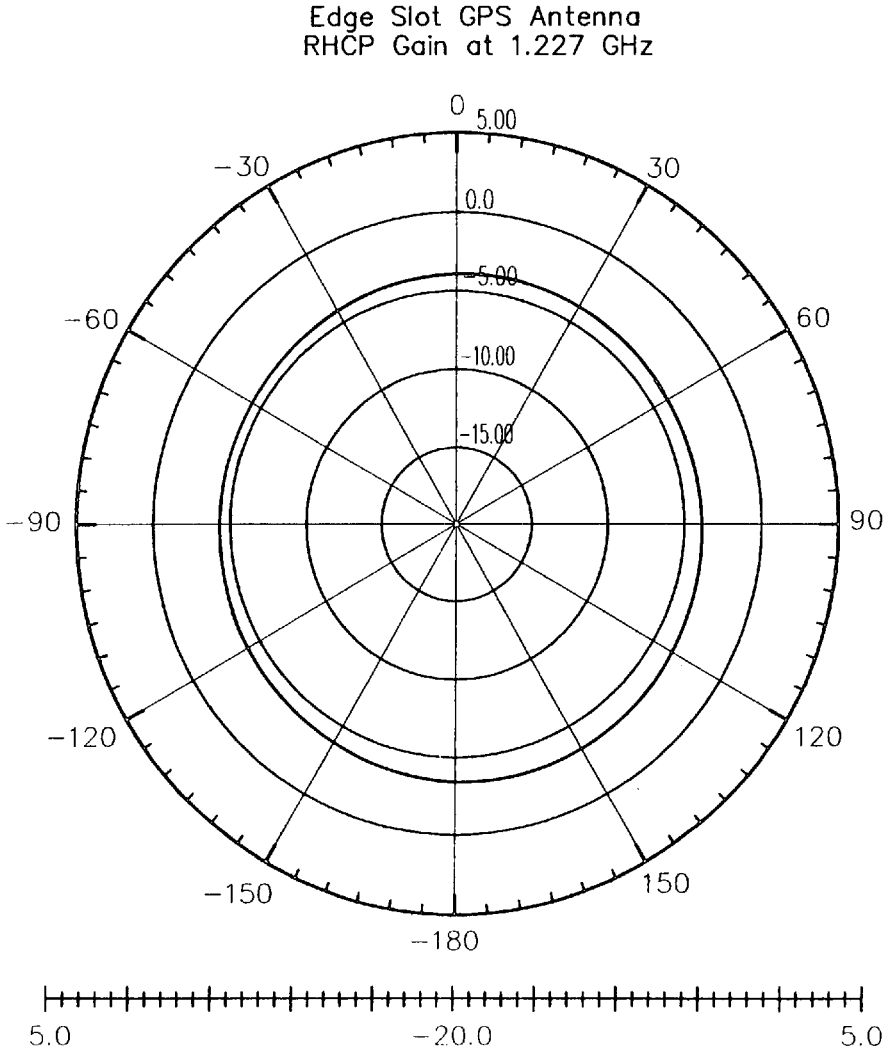
Figure 9:
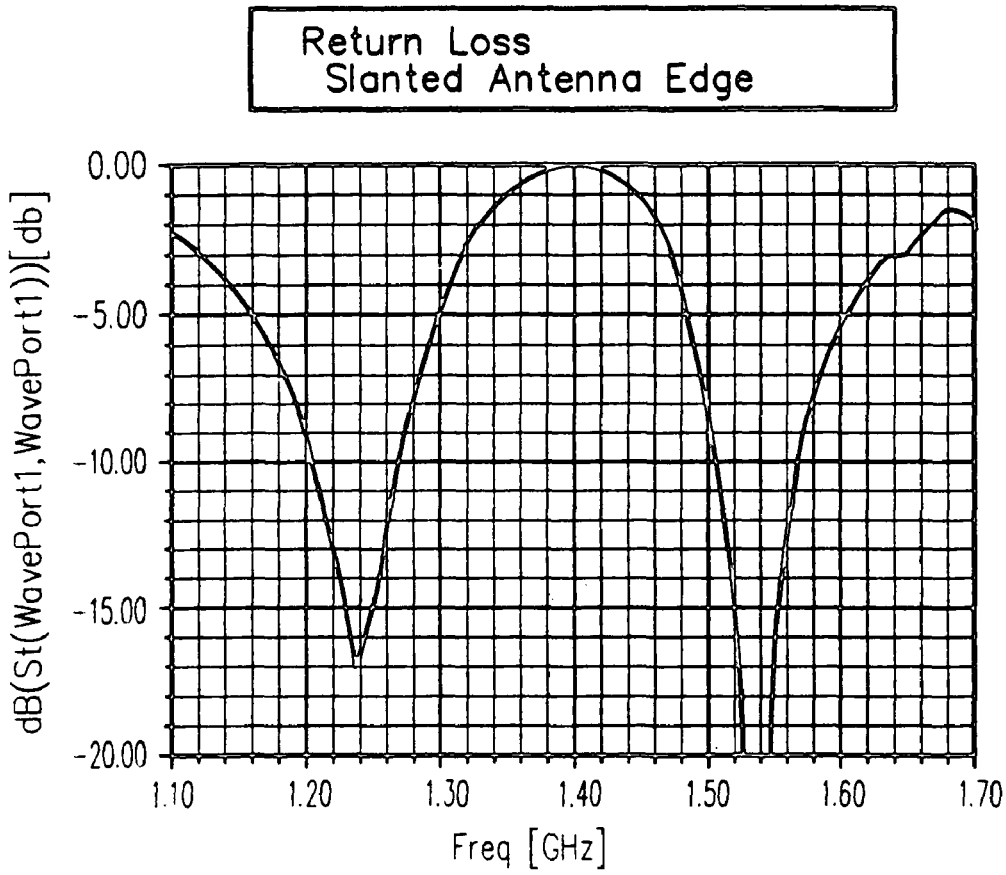
FIG. 9 is a graphical depiction indicating the dual band nature of the return loss which may be experienced by an edge-slot antenna(s)/antenna array of the present invention.

In exemplary embodiments, implementation of the radial transmission line antennas/edge slot antennas 200 in the present invention may promote production of a rotationally symmetric "monopole-like" radiation pattern. Additionally, the antennas 200 of the present invention may promote production of a radiation pattern which has a gain of 0 dB or better over much of the pattern. Also, the antennas 200 of the present invention may provide hemispherical coverage and may promote maximized GPS satellite reception and GDOP (Geometric Dilution of Precision). Further, said antennas 200 may allow for realization of far field phase symmetry in the roll axis via judicious placement of the shunt inductive posts 212. Still further, said antennas 200 of the antenna array may allow for provision of wide (azimuthal, elevational) pattern coverage during a large percentage of a flight trajectory of an artillery shell 100 with axial pattern null to final approach A/J. FIGS. 7A through 8B are illustrations of radiation patterns which may be produced by antenna(s) 200 of the present invention. A threat coordinate is referenced from an axis of the munitions shell, with theta=zero at the fuse of the shell. FIG. 6A represents a conical cut about the munitions shell. Further, FIG. 9 is a graphical illustration indicating dual band nature of the return loss which may be experienced by antenna(s) 200 of the present invention.

In additional embodiments, each of the antennas 200 (ex—GPS A/J antennas) of the array are "theta" polarized for promoting maximum A/J (anti-jamming) performance, which may allow for greater null depth capability. Further, the co-polarized antennas 200 may promote maximal utilization of classic array factor calculations in null.

Figure 5A:
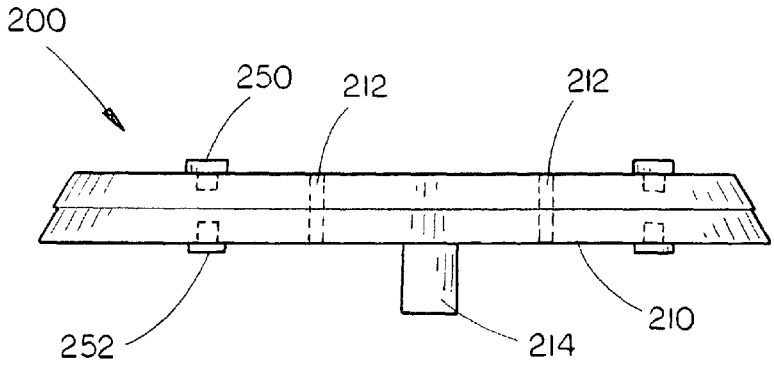
FIG. 5A is a perspective view of a dual band edge-slot antenna implementing tuning plungers in accordance with an exemplary embodiment of the present invention.
Figure 5B:
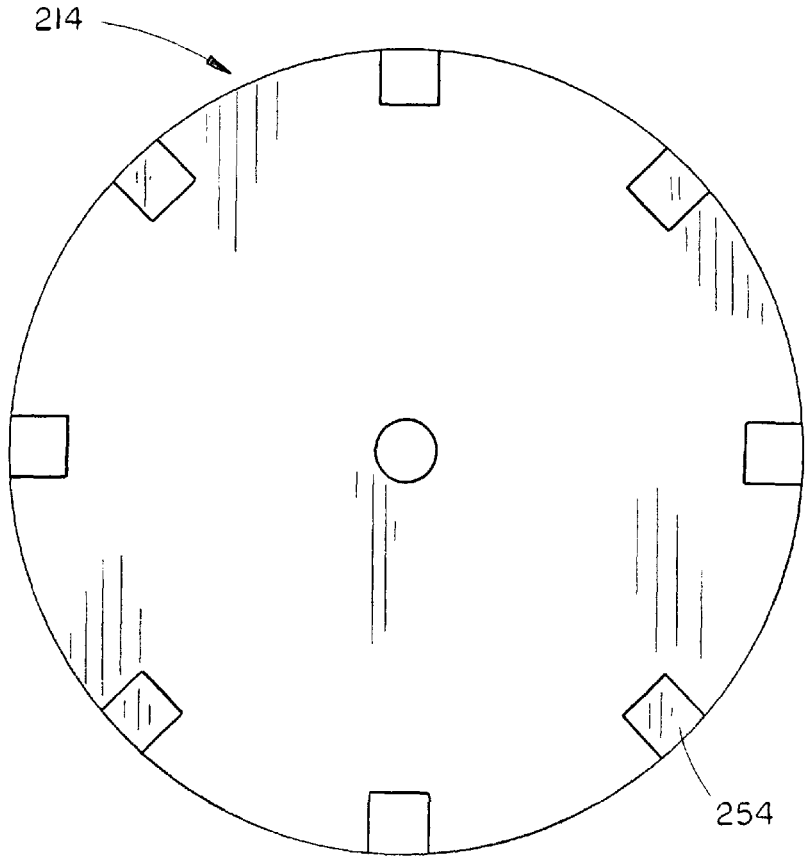
FIG. 5B is a sectional view of a ground surface of a dual band edge-slot antenna implementing capacitive tuning tabs in accordance with an exemplary embodiment of the present invention.

In alternative embodiments of the present invention shown in FIGS. 5A and 5B, the antenna(s) 200 may include tuning plungers which form capacitance to ground, which allow the tuning plungers to function as shunt L adjustable tuning plungers such as L1 tuning plungers 250 and L2 tuning plungers 252 which further allow for variable inductance tuning of the antenna(s) 200. In further alternative embodiments, the input pin 214 of the antenna(s) 200 may be configured to have capacitive tuning tabs 254 (ex—metallic tuning tabs), or similar patterned metallic geometries in close proximity to said input pin 214, for forming shunt capacitance to ground at the antenna input center pin 214 and/or for allowing tuning of the antenna(s) 200. In exemplary embodiments, the antenna 200 may form a nominal aperture/gap in a circumferential manner about the pin 214 for providing DC isolation. In further embodiments, dimensions/characteristics of the gap may be varied/altered as desired for facilitating impedance matching adjustment. In still further embodiments, a dielectric disc/layer (202, 204) may be truncated for tuning the antenna 200, which may promote expanded control in design and may further allow for use of standard Commercial Off-The-Shelf (COTS) materials.

In further alternative embodiments of the present invention, array flexibility may be increased by implementing various combinations of other radiating elements in conjunction with edge slot radiators in munitions/artillery shells/GPS munitions shells 100, such as the sectoral circular slot antenna array (see FIG. 6B) described in U.S. Pat. No. 6,307,514 entitled: "Method and System for Guiding an Artillery Shell", and/or the circumferential slot antenna described in U.S. Pat. No. 6,098,547 entitled: "Artillery Fuse Circumferential Slot Antenna for Positioning and Telemetry" both of which are hereby incorporated by reference in their entireties. Further alternatives may include implementing a combination of folded/multi-band folded monopole (potted fuse tip assembly) antenna variants (as shown in FIG. 6A) in conjunction with edge slot radiators.

Figure 10:
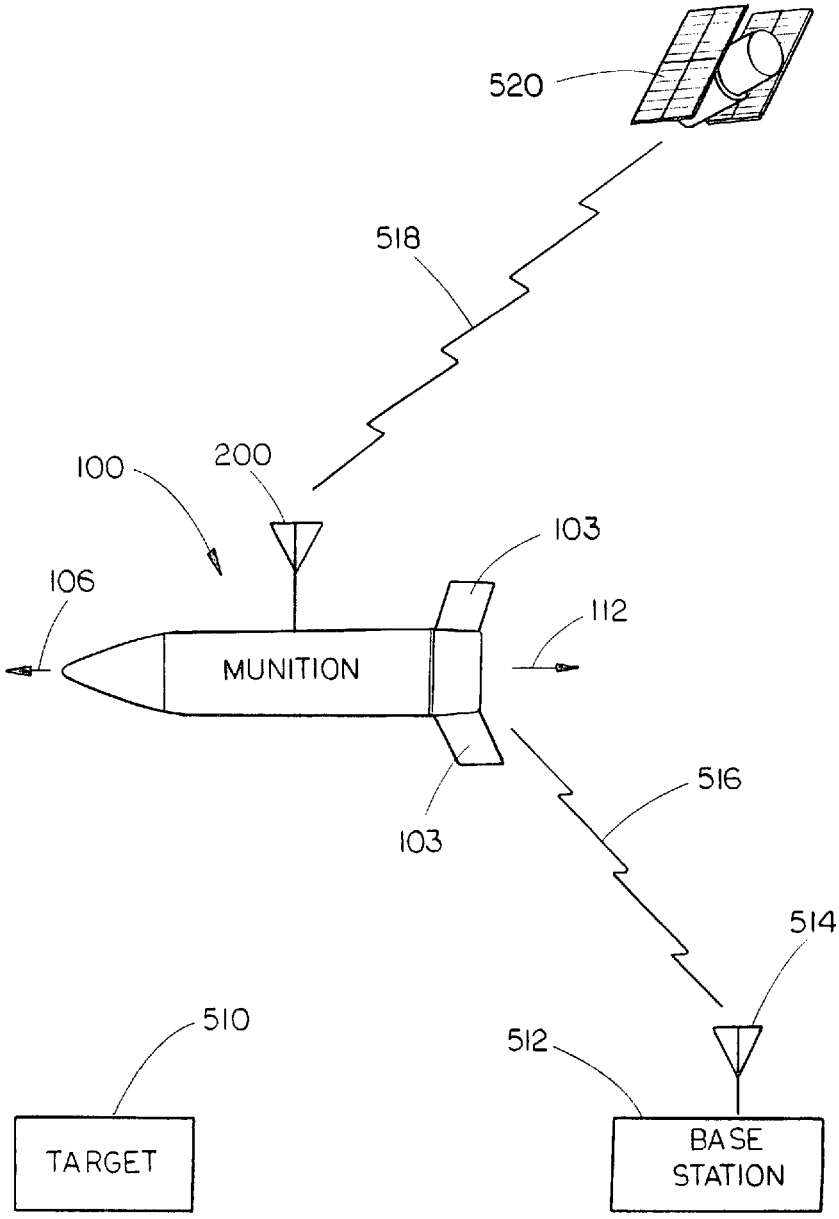
FIG. 10 is a communications schematic for an artillery shell/munition implementing an edge-slot antenna array of the present invention in accordance with an exemplary embodiment of the present invention.

Referring now to FIG. 10, there is shown a system of the present invention, which includes an artillery shell 100, which has been launched in a typical manner. The artillery shell 100 is moving in a forward direction 106 along a trajectory generally directed toward a target 510. The artillery shell has come from/originated from a rearward/aft direction 112 along the trajectory. In exemplary embodiments, it may be desirable to change the trajectory of the artillery shell 100, while said shell is in flight, in order to assure proper interaction with the target 510. In current embodiments of the present invention, the artillery shell 100 includes an on-board GPS receiver which continuously monitors the shell's position via a space directed signal 518 from satellite 520. The antenna array 200 may receive these GPS or other signals and may make course corrections either locally or via telemetry. Further, the antenna array may make other communications with a base station 512, through a terrestrial RF signal 516, and base station antenna 514. In additional embodiments, commands may be sent to the artillery shell 100 to deploy its retractable airfoil flaps 103, so as to change the aerodynamics, speed, and therefore, trajectory of the artillery shell 100. Still further, other signals, such as detonation commands for airborne detonation (of an explosive charge/payload of the shell), could be sent to the artillery shell 100 as well.

It is believed that the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. An artillery shell, comprising:

a payload;

a guidance system including a radio receiver; and a multi-element antenna array communicatively coupled to the radio receiver, the antenna array including a first antenna and a second antenna, wherein the first antenna and the second antenna are edge-slot antennas, wherein at least one of the first antenna and the second antenna are configured with at least one of: adjustable tuning plungers and capacitive, metallic tuning tabs.

2. An artillery shell as claimed in claim 1, wherein the edge-slot antennas are multi-band antennas.

3. An artillery shell as claimed in claim 1, wherein the edge-slot antennas are configured for supporting at least one of: L-band frequencies, S-band frequencies and C-band frequencies.

4. An artillery shell as claimed in claim 1, wherein the edge-slot antennas are configured for supporting L1 and L2 frequencies.

5. An artillery shell as claimed in claim 1, wherein the antenna array is a Global Positioning System (GPS) antenna array.

6. An artillery shell as claimed in claim 1, wherein the edge-slot antennas are fuse-mounted antennas.

7. An artillery shell as claimed in claim 1, wherein the first antenna and the second antenna are theta polarized.

8. A multi-element anti-jamming (A/J) antenna array, comprising:

a first edge-slot antenna; and a second edge-slot antenna, wherein the first edge-slot antenna and the second edge-slot antenna are configured for implementation within at least one of an artillery shell and a munition, wherein at least one of the first antenna and the second antenna are configured with at least one of: adjustable tuning plungers and capacitive, metallic tuning tabs.

9. A multi-element (A/J) antenna array as claimed in claim 8, wherein the edge-slot antennas are multi-band antennas.

10. A multi-element (A/J) antenna array as claimed in claim 8, wherein the edge-slot antennas are configured for supporting L-band frequencies.

11. A multi-element (A/J) antenna array as claimed in claim 8, wherein the edge-slot antennas are configured for supporting at least one of: S-band frequencies and C-band frequencies.

12. A multi-element (A/J) antenna array as claimed in claim 8, wherein the antenna array is a Global Positioning System (GPS) antenna array.

13. A multi-element (A/J) antenna array as claimed in claim 8, wherein the edge-slot antennas are fuse-mounted antennas.

14. A multi-element (A/J) antenna array as claimed in claim 8, wherein the first antenna and the second antenna are theta polarized.

15. A multi-element anti-jamming (A/J) antenna array, comprising:

a first multi-band GPS edge-slot antenna; and a second multi-band GPS edge-slot antenna, wherein the first edge-slot antenna and the second edge-slot antenna are configured for implementation within at least one of an artillery shell and a munition, the first edge-slot antenna and the second edge-slot antenna each being further configured for supporting L-band frequencies, wherein at least one of the first antenna and the second antenna are configured with at least one of: adjustable tuning plungers and capacitive, metallic tuning tabs.

16. A multi-element (A/J) antenna array as claimed in claim 15, wherein the edge-slot antennas are configured for supporting at least one of: S-band frequencies and C-band frequencies.

17. A multi-element (A/J) antenna array as claimed in claim 15, wherein the edge-slot antennas are fuse-mounted antennas.

18. A multi-element (A/J) antenna array as claimed in claim 15, wherein the first antenna and the second antenna are theta polarized.

* * * * *